US005476113A

United States Patent [19]

Lin et al.

[11] Patent Number: 5,476,113

[45] Date of Patent: Dec. 19, 1995

[54] UMBRELLA FOR CATCHING GOLF BALL

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 402,861

[22] Filed: Mar. 13, 1995

[51] Int. Cl.[6] ..... A45B 3/00

[52] U.S. Cl. ..... 135/16; 294/19.2; 294/25.41; 135/25.41

[58] Field of Search ..... 135/16, 25.4, 25.41, 135/75; 403/104, 352; 294/19.2; 273/32 F

[56] References Cited

U.S. PATENT DOCUMENTS

| | | | |
|---|---|---|---|
| 3,306,649 | 2/1967 | Zagwyn | 294/19.2 |
| 4,180,288 | 12/1979 | Sieners | 294/19.2 |
| 4,493,503 | 1/1985 | Jeninga | 294/19.2 |
| 4,515,402 | 5/1985 | Sedan | 294/19.2 |
| 4,659,125 | 4/1987 | Chuan | 294/19.2 |
| 4,733,681 | 3/1988 | Lee | 135/16 |
| 4,790,338 | 12/1988 | Strobl | 135/16 |
| 5,188,409 | 2/1993 | Forey | 273/32 F X |
| 5,261,434 | 11/1993 | Fodero | 135/16 |
| 5,368,352 | 11/1994 | Juhas | 294/19.2 |

*Primary Examiner*—Lanna Mai

[57] ABSTRACT

An umbrella includes: central shaft having a bucket holding portion recessed in a bottom grip portion of a handle of the hollow central shaft, and a ladle telescopically securable in the hollow central shaft and the handle having a bucket portion formed on an outer end of the ladle, whereby upon a withdrawal of the ladle from the central shaft, the bucket portion can be protruded forwardly to pick up a golf ball when far hit into a lake or a pond in the golf course.

5 Claims, 5 Drawing Sheets

UMBRELLA FOR CATCHING GOLF BALL

BACKGROUND OF THE INVENTION

When playing golf in a golf course, it is possible to strike or pitch a golf ball into a lake, a river or a pond. If there is no tool such as a bucket or a net, it will be difficult to pick up the golf ball to thereby cause loss of money. A professional bag with a full set of clubs plus accessories in the pockets is to heavy to further attach the tool for catching the golf ball when dropped into water.

An umbrella is always provided for a wet weather or for other protections, having become a necessary tool in a golf game or practice.

It is therefore invented by the present inventor an umbrella having means for catching golf ball when hit into a water pond, lake or river.

SUMMARY OF THE INVENTION

The object of the present invention is to provide an umbrella including: a central shaft having a bucket holding portion recessed in a bottom grip portion of a handle of the hollow central shaft, and a ladle telescopically securable in the hollow central shaft and the handle having a bucket portion formed on an outer end of the ladle, whereby upon a withdrawal of the ladle from the central shaft, the bucket portion can be protruded forwardly to pick up a golf ball when far hit into a lake or a pond in the golf course.

DETAILED DESCRIPTION

Figure 1:
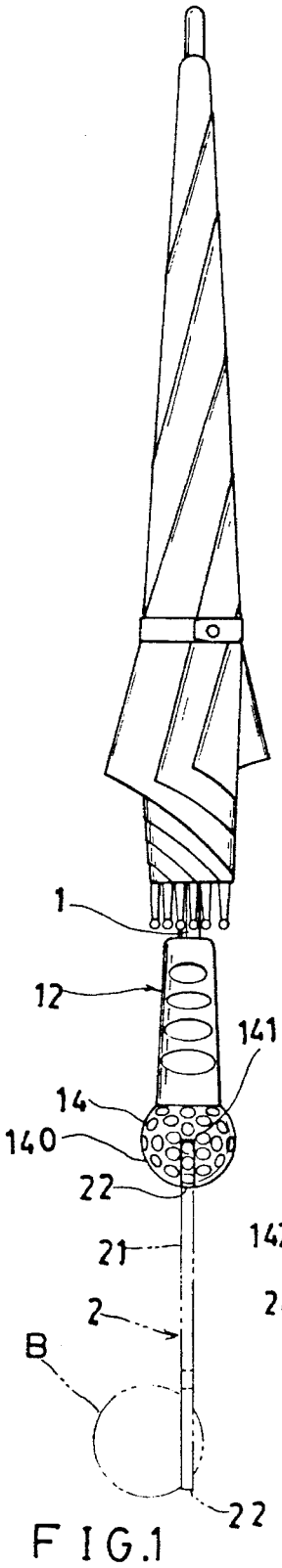
FIG. 1 is an illustration of the present invention when folded or retracted.

As shown in FIGS. 1–4, an umbrella of the present invention comprises: a hollow central shaft 1, and a ladle member 2 telescopically securable in the central shaft 1.

The hollow central shaft 1 includes: a central hole 11 formed in a central portion of the shaft 1, a handle 12 formed on a lower portion of the central shaft 11, and a bottom grip portion 14 formed on a bottom portion of the handle 12 having a stopping portion 13 formed in a lower end of the central hole 11 for limiting an outwardly releasing of the ladle member 2 from the shaft 1.

The bottom grip portion 14 includes: a spherical surface 140 circumferentially formed on an outer surface of the bottom grip portion 14 and may be designed to have a corrugated surface for simulating a golf ball for decorative purpose, a bucket holding socket 141 recessed in the bottom grip portion 14 for engaging a bucket portion 22 of the ladle member 2, and at least a protrusion hole 142 recessed in the socket 141 for engaging at least a protrusion 24 formed on the bucket portion 22 of the ladle member 2.

Figure 3:
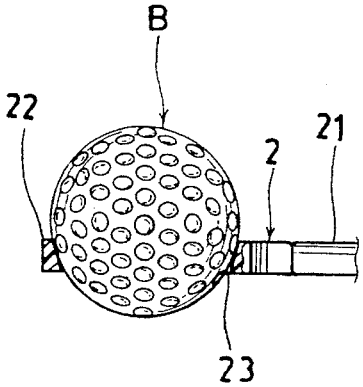
FIG. 3 is an illustration When catching a golf ball on the bucket portion of the ladle member.
Figure 4:
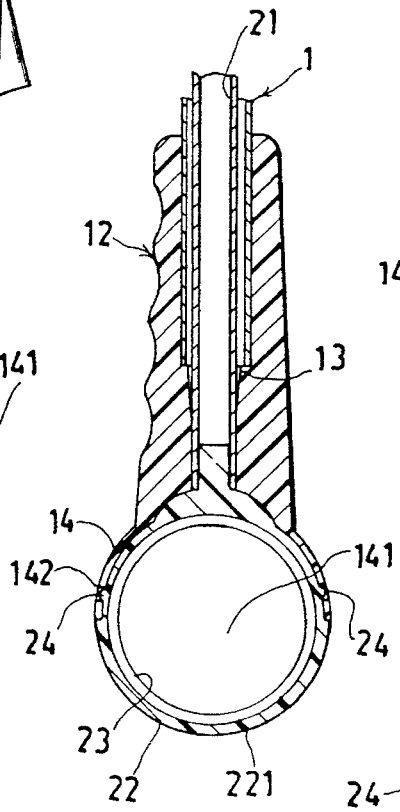
FIG. 4 is a partial sectional drawing of the present invention when retracting the bucket portion into the shaft.
Figure 2:
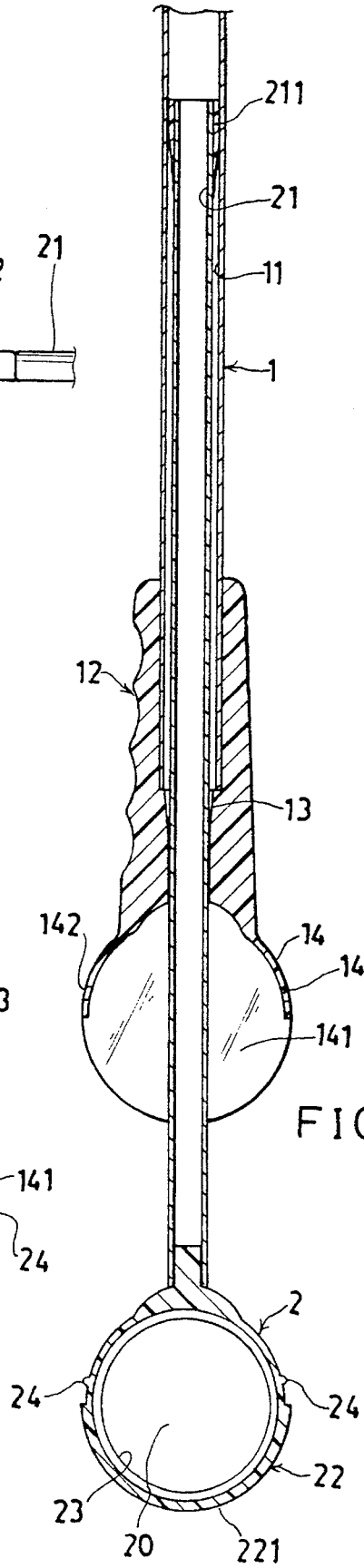
FIG. 2 is a partial sectional drawing of the present invention when withdrawing the ladle member outwardly.

The ladle member 2 includes: a stem portion 21 longitudinally telescopically engageable with the central hole 11 in the central shaft 1, a bucket portion 22 formed on a bottom end of the stem portion 21 to be engageably received in the bucket holding socket 141 recessed in the bottom grip portion 14 of the handle 12, and a seating rim 23 circularly formed on an inside wall of a central opening 20 defined in a central portion of the bucket portion 22, with the central opening 20 having a diameter slightly smaller than a diameter of a golf ball B for seating the golf ball B on the seating rim 23 as shown in FIG. 3 when picking up the ball B.

The bucket portion 22 of the ladle member 2 has an outer arcuate surface 221 coplanar to the spherical surface 140 of the bottom grip portion 14 for completing a smooth spherical surface of the grip portion 14 when retracting the bucket portion 22 into the socket 141 and retracting the stem portion 21 into the central hole 11 of the shaft 1, having at least a protrusion 24 formed on the bucket portion 22 to be engaged with a protrusion hole 142 recessed in the bottom grip portion 14 for stably engaging the ladle member 2 with the shaft 1 and the handle 12 when retracting the ladle member 2 into the shaft 1.

The stem portion 21 of the ladle member 2 includes a limiting cap 211 formed on an innermost end of the stem portion 21 and engageable with a stopping portion 13 formed in a lower end of the central hole 11 for limiting the stem 21 without being released from the shaft 1 when withdrawing the ladle member 2 outwardly from the shaft 1. The seating rim 23 may be formed with a spherical or arcuate surface on the rim for a stable engagement with the ball B.

When the bucket portion 22 of the ladle member 2 is outwardly withdrawn from the shaft 1, a ball B may be rested on the seating rim 23 as shown in FIG. 3 to pick up a ball as dropped onto a water surface of a river, a pond or a lake in a golf course. A lower portion of the ball B may protrude downwardly from the rim 23 for a stable engagement between the ball B and the bucket portion 22.

The present invention may be modified without departing from the spirit and scope of this invention.

Figure 5:
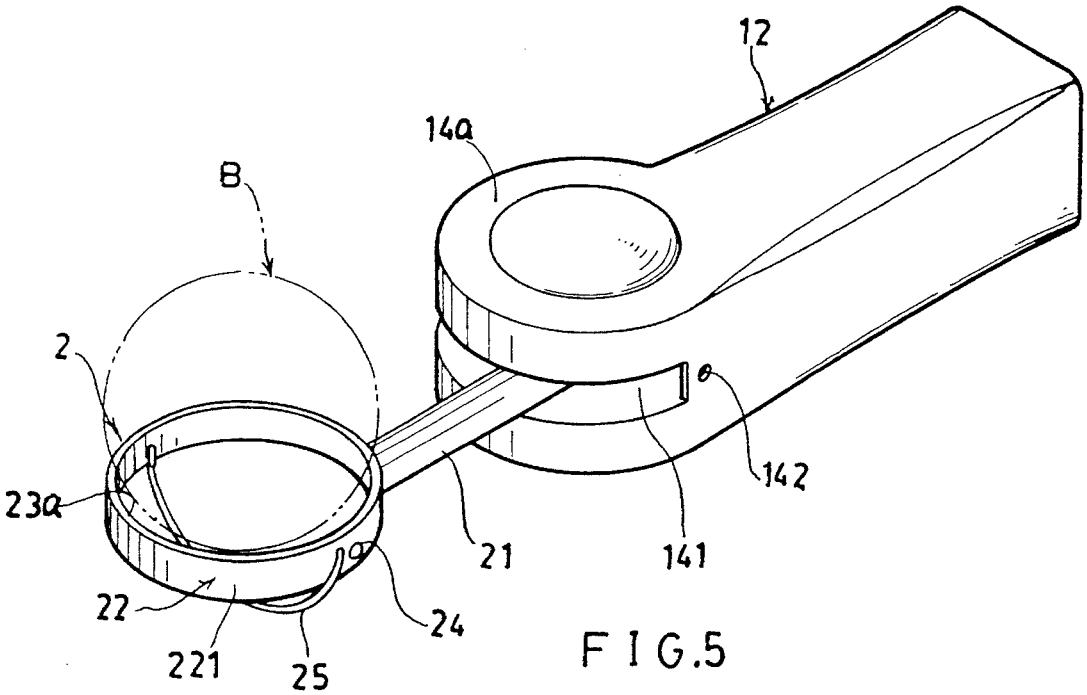
FIG. 5 is a perspective view of another preferred embodiment of the present invention.
Figure 6:
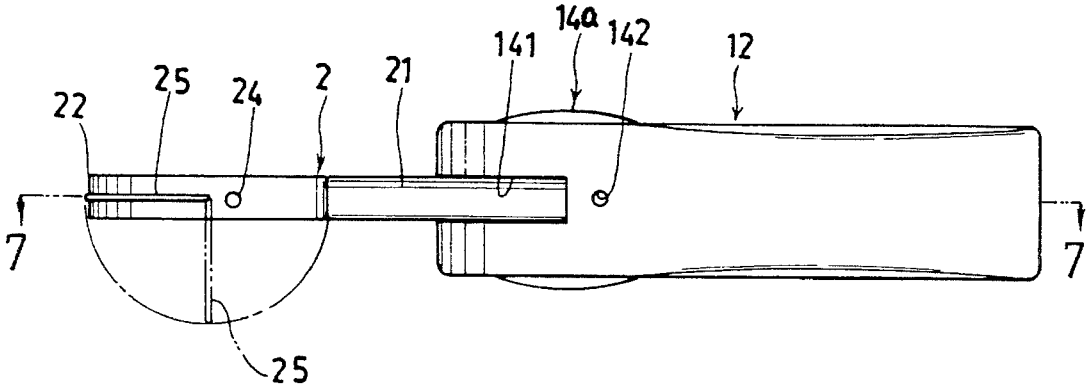
FIG. 6 is a side view of the present invention as shown in FIG. 5.
Figure 7:
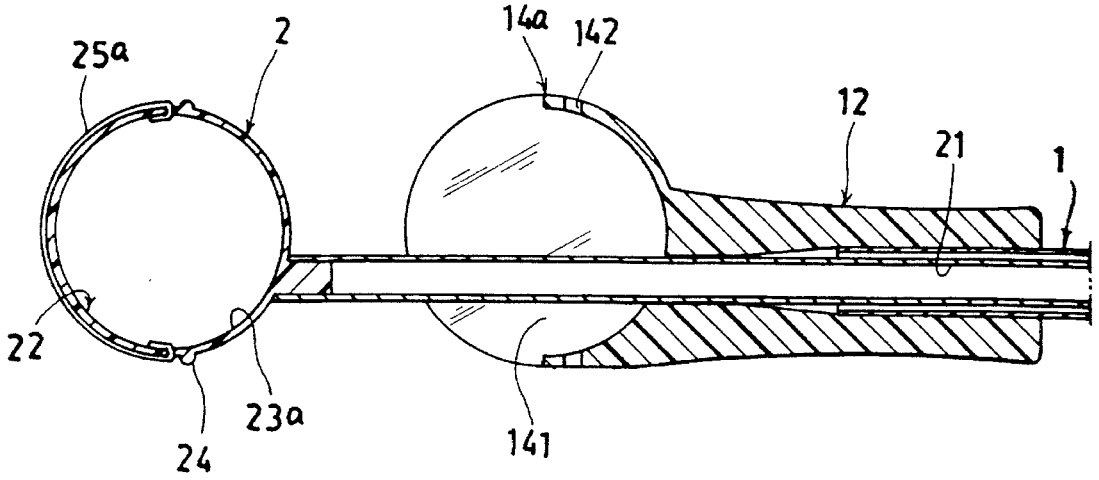
FIG. 7 a sectional drawing of the present invention when viewed from 7—7 direction of FIG. 6.

As shown in FIGS. 5–7, the bucket portion 22 of the ladle member 2 may include: a .fastener member 25 generally semi-circular shaped and pivotally diametrically secured on the bucket portion 22 for holding a lower ball portion of the golf ball B when rested on the seating rim 23a of the bucket portion 22.

Figure 8:
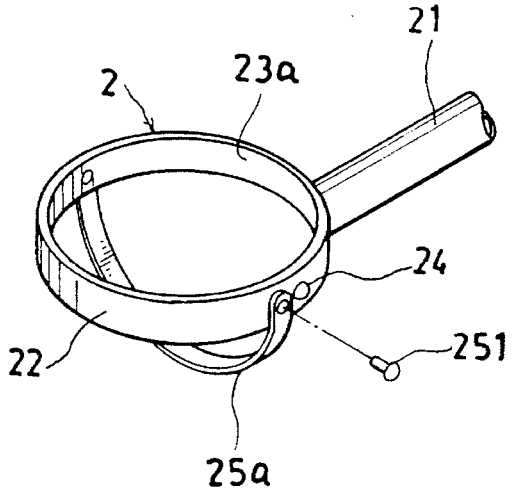
FIG. 8 shows another preferred bucket portion as modified from FIG. 5 in accordance with the present invention.

The fastener member 25 may be formed as a rope as shown in FIG. 5 or formed as a band or strip 25a pivotally secured on the bucket portion 22 by a pair of pins 251 as shown in FIG. 8, not limited in this invention.

The seating rim 23*a* as shown in FIGS. 5–8 may be a cylindrical wall of the central opening 20 in the bucket portion 22 for holding the ball B.

The bottom grip portion 14*a* as shown in FIGS. 5–7 may be formed as a shallow cylindrical disk.

Figure 9:
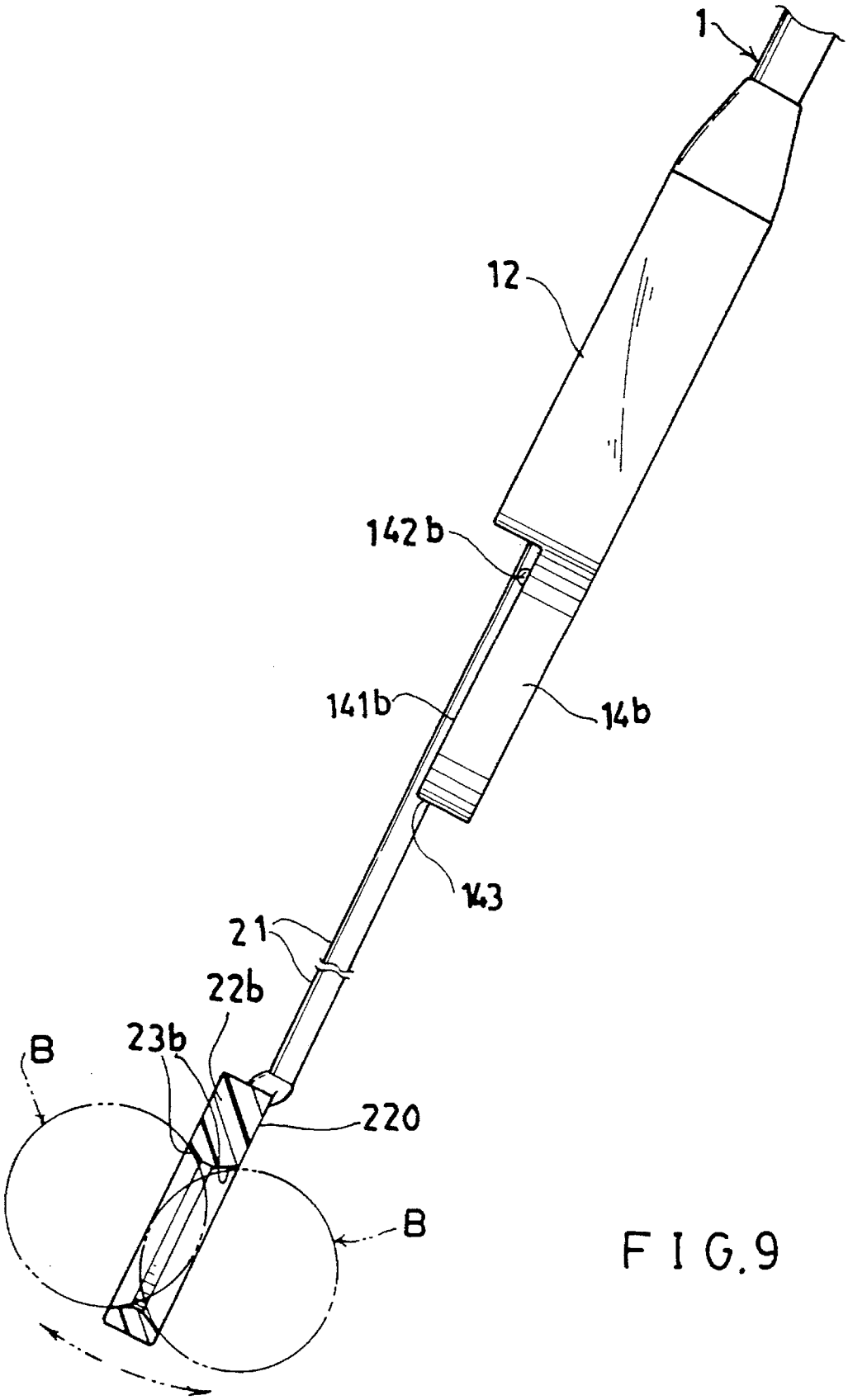
FIG. 9 shows still another preferred embodiment of the present invention.
Figure 10:
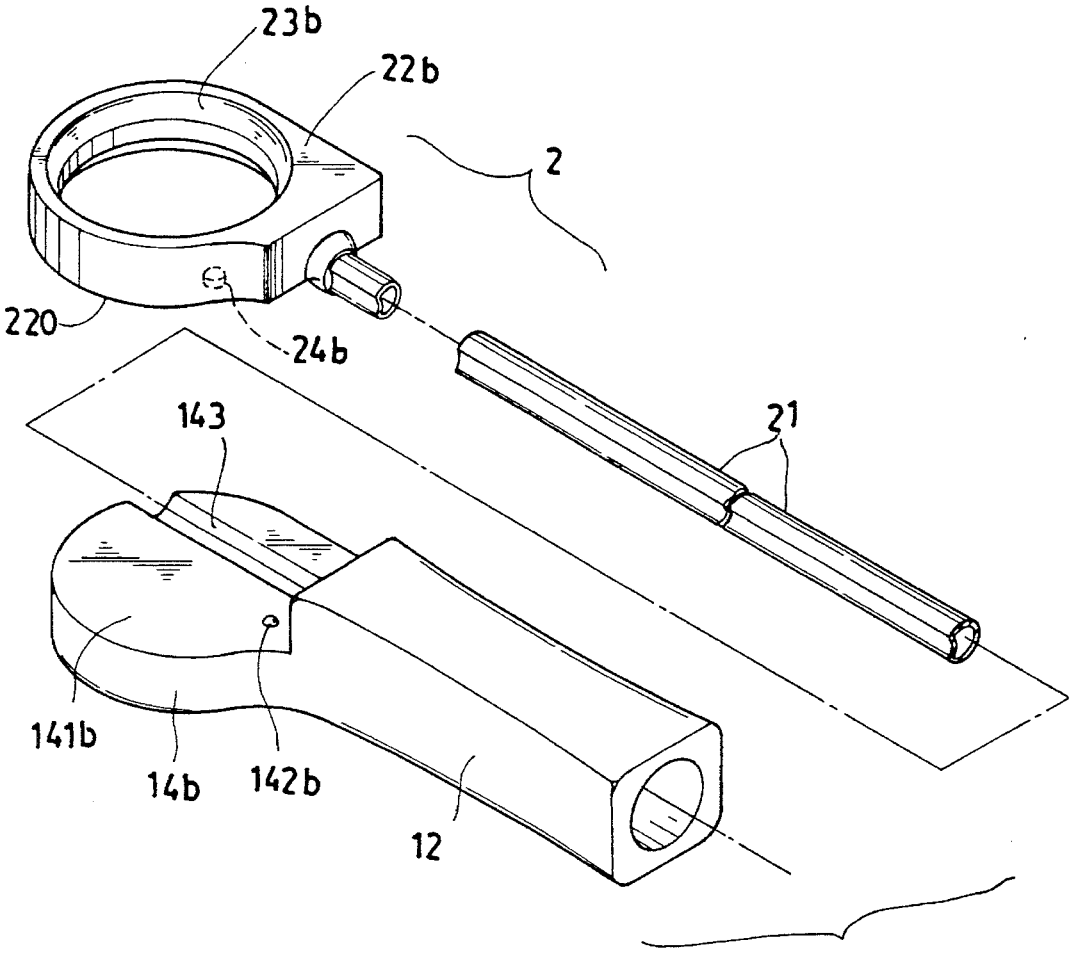
FIG. 10 is an exploded view showing the relevant parts of the present invention of FIG. 9.
Figure 11:
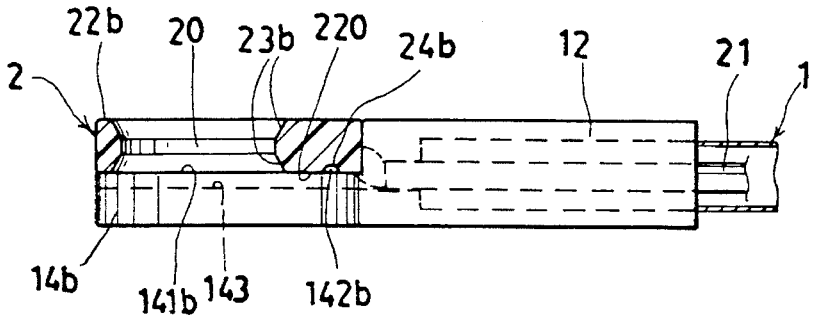
FIG. 11 is a partial Sectional drawing of the present invention when retracting the bucket portion from the state as shown in FIG. 9 to the bottom grip portion of the umbrella handle.

As shown in FIGS. 9–11, the present invention may be further modified to include: a bottom grip portion 14*b* formed as a first half-disk portion combinably coupled with a second half-disk portion of the bucket portion 22*b* to integrally form a cylindrical disk adjacent to the handle 12 for gripping purpose, and a stem portion 21 protruding towards the central hole 11 of the shaft 1 from a central portion of a bottom surface 220 of the bucket portion 22*b* and slidably engageable with a stem groove 143 longitudinally recessed in a bucket holding base 141*b* formed on the bottom grip portion 14*b*, the bottom surface 220 engageable with the bucket holding base 141*b*.

The bucket portion 22*b* as shown in FIGS. 9, 11 includes: two seating rims 23*b* respectively tapered on two opposite sides of the bucket portion 22*b*, each seating rim 23*b* defining a central opening 20 having a diameter smaller than that of the golf ball B for resting a golf ball on each seating rim 23*b* on either side of the bucket portion 23*b*.

The bottom grip portion 14*b* has a protrusion 142*b* formed on the holding base 141*b* to be engageable with a recess 24*b* recessed in a bottom surface 220 of the bucket portion 22*b* for a stable engagement between the bucket portion 22*b* and the bottom grip portion 14*b* when integrally combined to be a cylindrical disk.

Other modifications can still be made by those skilled in the art, not limited in this invention.

I claim:

1. An umbrella comprising:

a hollow central shaft having a handle formed on a lower portion of said shaft, a central hole formed through said handle and said central shaft, and a bottom grip portion formed on a bottom of said handle for gripping; and a ladle member telescopically securable in said central shaft and normally retractable into said central shaft for portable purpose, and having a bucket portion secured on an outer end of the ladle member and normally retractable into a recess in said bottom grip portion for gripping when retracting said ladle member into said hollow central shaft, said bucket portion operatively withdrawn from said grip portion for picking a golf ball on said bucket portion when said ladle member is withdrawn outwardly from said central shaft;

said bottom grip portion on said central shaft including: a spherical surface circumferentially formed on an outer surface of the bottom grip portion, a bucket holding socket recessed in the bottom grip portion for engaging the bucket portion of the ladle member, and at least a protrusion hole recessed in the socket for engaging at least a protrusion formed on the bucket portion of the ladle member.

2. An umbrella according to claim 1, wherein said bucket portion of the Ladle member has an outer arcuate surface coplanar to the spherical surface of the bottom grip portion for completing a smooth spherical surface of the grip portion when retracting the bucket portion into the bucket holding socket and retracting the ladle member into the shaft.

3. An umbrella according to claim 1, wherein said bottom grip portion is formed as a first half-disk portion having a holding base formed on said grip portion combinably coupled with a second half-disk portion of the bucket portion having a bottom surface formed on said bucket portion coupled to said holding base to integrally form a cylindrical disk adjacent to the handle for gripping purpose, and a stem portion protruding inwardly towards said shaft from a central portion of the bottom surface of the bucket portion and slidably engageable with a stem groove longitudinally recessed in the bucket holding base formed on the bottom grip portion.

4. An umbrella according to claim 3, wherein said bucket portion includes: two seating rims respectively tapered on two opposite sides of the bucket portion, said two seating rims defining a central opening having a diameter smaller than that of the golf ball for resting a golf ball on each said seating rim of the bucket portion.

5. An umbrella according to claim 3, wherein said bottom grip portion has a protrusion formed on the holding base of said grip portion to be engageable with a recess recessed in the bottom surface of the bucket portion for a stable engagement between the bucket portion and the bottom grip portion when integrally combined to form said cylindrical disk.

* * * * *